US008579642B2

(12) United States Patent
Berendes

(10) Patent No.: US 8,579,642 B2
(45) Date of Patent: Nov. 12, 2013

(54) DEVICE FOR PRODUCING AND REMOVING AN ELECTRICAL PLUG CONNECTION

(75) Inventor: Elmar Berendes, Warburg-Nörde (DE)

(73) Assignee: Wincor Nixdorf International GmbH (DE)

( * ) Notice: Subject to any disclaimer, the term of this patent is extended or adjusted under 35 U.S.C. 154(b) by 436 days.

(21) Appl. No.: 12/936,052

(22) PCT Filed: Apr. 14, 2009

(86) PCT No.: PCT/EP2009/054411

§ 371 (c)(1),
(2), (4) Date: Oct. 21, 2010

(87) PCT Pub. No.: WO2009/127629

PCT Pub. Date: Oct. 22, 2009

(65) Prior Publication Data

US 2011/0065302 A1 Mar. 17, 2011

(30) Foreign Application Priority Data

Apr. 14, 2008 (DE) ..... 10 2008 018 721

(51) Int. Cl.
*H01R 11/22* (2006.01)

(52) U.S. Cl.
USPC ..... 439/266; 439/257; 439/374; 361/727

(58) Field of Classification Search
None
See application file for complete search history.

(56) References Cited

U.S. PATENT DOCUMENTS

| | | | | |
|---|---|---|---|---|
| 5,622,511 | A | 4/1997 | Jarrett | |
| 5,805,420 | A * | 9/1998 | Burke | 361/727 |
| 6,270,371 | B1 | 8/2001 | Doushita | |
| 6,315,583 | B1 | 11/2001 | Nishioka | |
| 6,878,001 | B2 * | 4/2005 | Nishide | 439/157 |
| 7,466,544 | B2 * | 12/2008 | Hardt et al. | 361/679.41 |
| 7,758,359 | B2 * | 7/2010 | Chiu et al. | 439/131 |
| 8,033,843 | B2 * | 10/2011 | Ambo et al. | 439/157 |
| 2004/0058574 | A1 | 3/2004 | Nishide | |
| 2005/0036743 | A1 | 2/2005 | Dugas | |
| 2009/0147485 | A1 * | 6/2009 | Higashigawa et al. | 361/727 |

FOREIGN PATENT DOCUMENTS

| | | |
|---|---|---|
| CN | 1290978 | 4/2001 |
| CN | 1836181 | 9/2006 |
| DE | 199 19 380 A1 | 11/1999 |
| DE | 695 24 322 T2 | 8/2002 |
| DE | 602 12 291 T2 | 4/2007 |
| EP | 1 403 979 A1 | 3/2004 |
| JP | 11-312551 | 11/1999 |

* cited by examiner

*Primary Examiner* — Michael Zarroli
(74) *Attorney, Agent, or Firm* — Harness, Dickey & Pierce, P.L.C.

(57) ABSTRACT

One plug connecting element is mounted on its device part in a side wall of a recess. The other plug connecting element is mounted on a swivel holder. When the one device part is inserted into the other device part, the swivel initially pushes the other plug out of the way of the one device part as it is being inserted. Further insertion causes the swivel holder to move the other plug into the recess in a position to mate with the one plug.

10 Claims, 5 Drawing Sheets

DEVICE FOR PRODUCING AND REMOVING AN ELECTRICAL PLUG CONNECTION

CROSS-REFERENCE TO RELATED APPLICATIONS

This application is a National Stage of International Application No. PCT/EP2009/054411, filed Apr. 14, 2009. This application claims the benefit and priority of German application 10 2008 018 721.6, filed Apr. 14, 2008. The entire disclosures of the above applications are incorporated herein by reference.

BACKGROUND

This section provides background information related to the present disclosure which is not necessarily prior art.

TECHNICAL FIELD

The invention relates to a device for establishing and disconnecting an electrical plug connection, the first plug connecting element and the second plug connecting element of which are connected to each other on device parts when the latter are brought together, wherein the device parts can be moved relative to each other with restricted guidance and are guided against each other, as well as are separated from each other when the device parts are separated, in particular for electrically contacting circuits of a plug-in device with circuits of a device frame receiving the plug-in device.

Discussion

For devices of this type, it is already known to mount the two plug connecting elements such that they are inevitably connected to each other when their device parts are brought together and reach their final position. An example of this application of plug connections is the circuit board which is inserted into a device frame and when reaching its final position engages via a plug connecting element mounted thereon into a plug connecting element mounted on the device frame. A further example is a plug-in device having a housing which is inserted into the device frame and, when reaching its final position, is likewise electrically connected via the two elements of a plug connection to circuits in the device frame.

As long as there is sufficient space in the direction of the depth of the device frame on both carriers, the plug connection can be realized in the area of the rear side of the device frame, i.e. the two plug connecting elements are then mounted on the front end (in the plug-in direction) of the one carrier, that is, e.g. a circuit board, and in the area of the rear side of the device frame. However, there are also applications in particular for box-like plug-in modules and the device frames receiving the same in which the position of the plug connection in the afore-described manner is not desired as a result of a limited space and a desired small structural depth as well as for an easier handling of a device. This applies, for example, to plug-in devices which must be accessible not only for maintenance purposes but the use of which also has to be possible even when they are outside of their device frame.

Such devices are, for example, banknote containers, which are inserted into cash depositing and/or cash withdrawal machines, however, have to be taken out on a regular basis for emptying or, respectively, refilling. Their front and rear sides have to be accessible for pull-off mechanisms and one must be able to open them. An electrical plug connection is not desired in these areas, and therefore they have been arranged on a housing side wall or, respectively, on the inside of the plug-in opening of the device frame.

When a module is often used, i.e. when establishing and disconnecting the plug connection and when handling the plug-in devices, a lateral arrangement of the plug connection is inconvenient since both of its elements project laterally and thus also require increased space which exclusively serves the plug connection and negatively affects the guiding properties of both device parts when these are moved with restricted guidance.

SUMMARY OF THE INVENTION

An object of the invention is to specify a device for establishing a plug connection which, without negatively affecting the guiding properties of both device parts during their sliding movement, allows for a reliable contact with a space requirement as little as possible and guarantees an obstruction-free handling of a device to be contacted.

By the invention a plug connection is established in the lateral area of the device parts to be electrically connected to each other, which connection does not impede the relative sliding of the device parts because one of the plug connecting elements is arranged countersunk in its device part and the other plug connecting element is moved out of the range of motion on its device part when both device parts are in their sliding state.

In the separated state of the two device parts, one of the plug connecting elements projects laterally from its carrier, i.e. it projects into the range of motion of the two device parts and is in its connecting position. When the two device parts are now brought together and the second device part is inserted into the first one, then the first plug connecting element is temporarily moved out of its connecting position and allows an unimpeded sliding movement of the two device parts relative to each other until, when moved further, it engages into the recess of the second device part by the spring force and is then again opposite to the second plug connecting element so that by means of a further sliding movement it is plugged together with the second plug connecting element.

During separation of the two device parts, the plug connection is at first again disconnected as long as the recess of the second device part is still in the area of the movably mounted first plug connecting element. Upon a further separating movement, the recess is moved out of this area, and the second device part then again acts on the movable holder of the first plug connecting element and moves it out of the recess so that both device parts can be separated from each other in an unimpeded manner.

The invention avoids an arrangement of the plug connecting elements in areas in which they can negatively affect the handling of a plug-in device. Since one of the plug connecting elements can be moved out of the area of restrictive guidance, while the other plug connecting element is arranged in a recess, the entire device can be arranged in the area of a longitudinal side wall of the two device parts without impeding their mutual guidance. In doing so, space is only required for the recess in one of the two device parts which is dimensioned such that it can receive both plug connecting elements and allows their separating movement.

BRIEF DESCRIPTION OF THE DRAWINGS

In the following, the invention will be explained in more detail with reference to the drawing.

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

In FIGS. 1A to D, the various positions are illustrated which two device parts movable relative to each other with restrictive guidance can assume, which device parts each carry a plug connecting element. As plug connecting elements, a plug strip and a socket strip each can be provided, as these are known for the electrical switching of devices.

The arrangement schematically illustrated in FIGS. 1A to D is a rack frame 10 and a plug-in device 20 slidable therein. In the simplest case, this can be a circuit board on which electrical circuits and components are arranged, which, in a final plug-in position, are to be electrically connected to further circuits in the rack frame 10 via a plug connection. The application of the invention to be described here relates to the use in a box-like plug-in device, in particular a banknote container. In this banknote container preferably at least one electric drive and/or at least one sensor is arranged which is electrically connected via the plug connecting elements to a control circuit arranged outside of the banknote container. Alternatively or additionally, at least one sensor can be arranged in the banknote container which via the plug connecting elements is connected to a control circuit arranged outside of the banknote container.

Figure 1A:
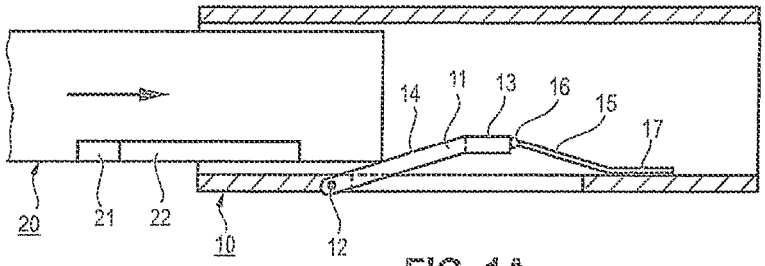
FIG. 1A to 1G show schematic illustrations of several positions of two device parts having plug connecting elements and being movable relative to each other with restrictive guidance.

In FIGS. 1A to D, the rack frame 10 and the plug-in device 20 are each time illustrated in a top view, the rack frame 10 being shown in a horizontal section. FIG. 1A shows a first position in which the plug-in device 20 has been inserted into the rack frame 10 already so far from the left side that it abuts with its front lateral edge a swivel arm 11 which is pivotally mounted in the rack frame 10 at 12.

The swivel arm 11 carries on its free end a plug connecting element 13 in such an angled position that, in the illustrated position of the swivel arm 11, it is aligned with a further plug connecting element 21 which is mounted in a lateral recess 22 of the plug-in device 20 and forms the counterpart to the plug connecting element 13.

The plug-in device 20 hits with its front lateral edge a control edge 14 of the swivel arm 11 and swivels it out of the range of motion against the force of a leaf spring 15 upon further movement. The leaf spring 15 is articulated to the swivel arm 11 at 16 in a manner still to be described and is stationarily connected to the device frame 10 at 17.

Figure 1B:
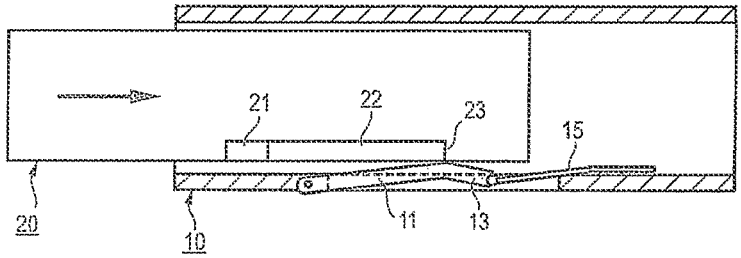

When the swivel arm 11 is moved as a result of the further sliding movement of the plug-in device 20 in the direction of the arrow as illustrated, the leaf spring 15 is deflected so far that it eventually assumes the position shown in FIG. 1B in which the swivel arm 11 with the plug connecting element 13 is practically completely moved out of the range of motion of the two device parts 10 and 20 for the plug connecting elements 13 and 21. The front edge of the recess 22 of the plug-in device 20 is in this position shortly set back from the free end of the swivel arm 11 so that the swivel arm cannot change its position until the plug-in device 20 has reached this position.

Figure 1C:
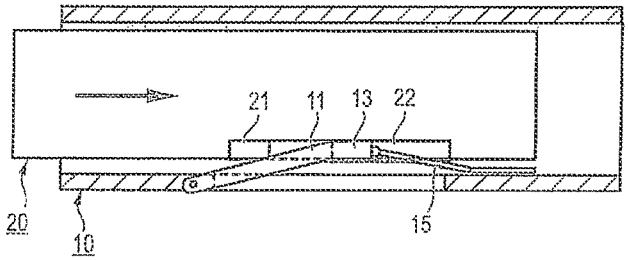

When the plug-in device 20 is moved further in the direction of the arrow as illustrated, the swivel arm 11 can engage into the recess 22 of the plug-in device 20 by the force of the leaf spring 15 and thus brings the plug connecting element 13 mounted thereon again in the connecting position in which it is opposite to the plug connecting element 21 of the plug-in device 20 and which is illustrated in FIG. 1C.

Figure 1D:
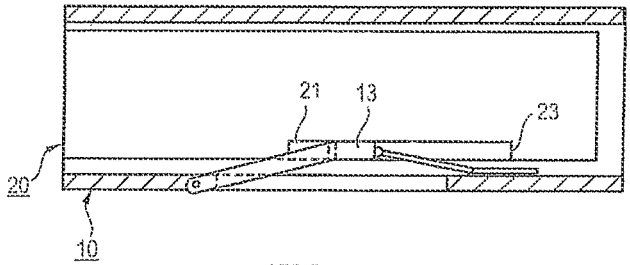
Figure 1E:
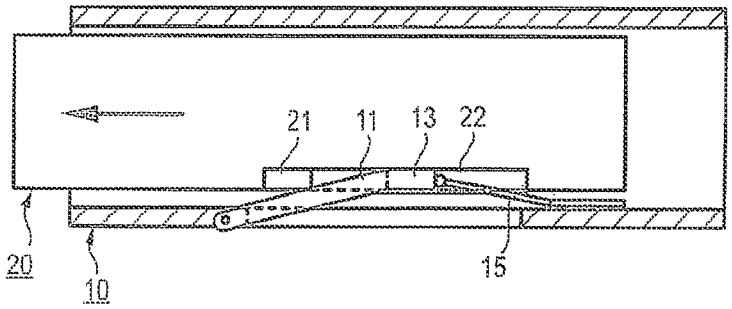
Figure 1F:
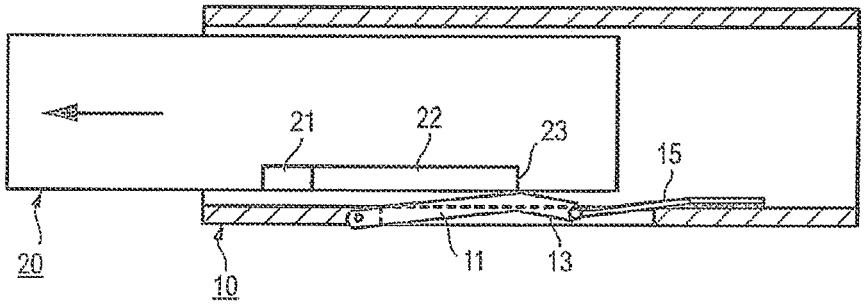
Figure 1G:
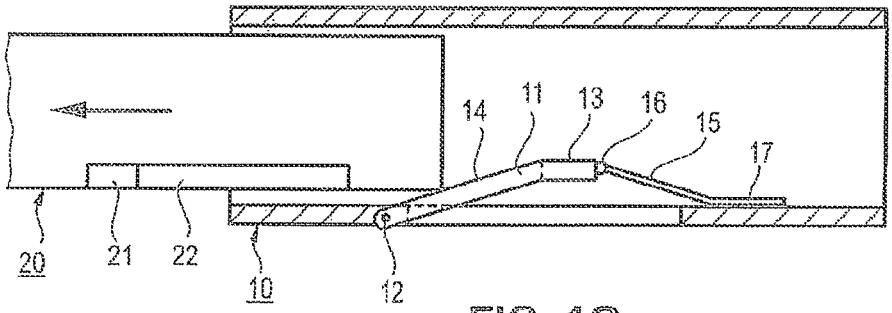

FIG. 1D finally shows the final position of the plug-in device 20 in which the two plug connecting elements 13 and 21 are connected to each other and the plug-in device 20 is completely inserted into the device frame 10. When the plug-in device 20 is pulled from this position in the direction of the arrow as illustrated in FIG. 1D to the left and out of the device frame 10, then the front edge 23 of the recess 22 hits the leaf spring 15 which now forms a control surface that is inclined to the sliding path and which is moved out of the range of motion of the plug-in device 20. As a result thereof, the position of the swivel arm 11 shown in FIG. 1B is again reached, in which it does not impede the sliding movement.

From the above described sequences of motions, it can be seen that the recess 22 must have a length in sliding direction which at least corresponds to the length of the plug-connected plug connecting elements 13 and 21 plus their mutual distance immediately after disconnecting the plug connection. Its depth is determined by the thickness of the plug connecting elements 13 and 21.

Figure 2:
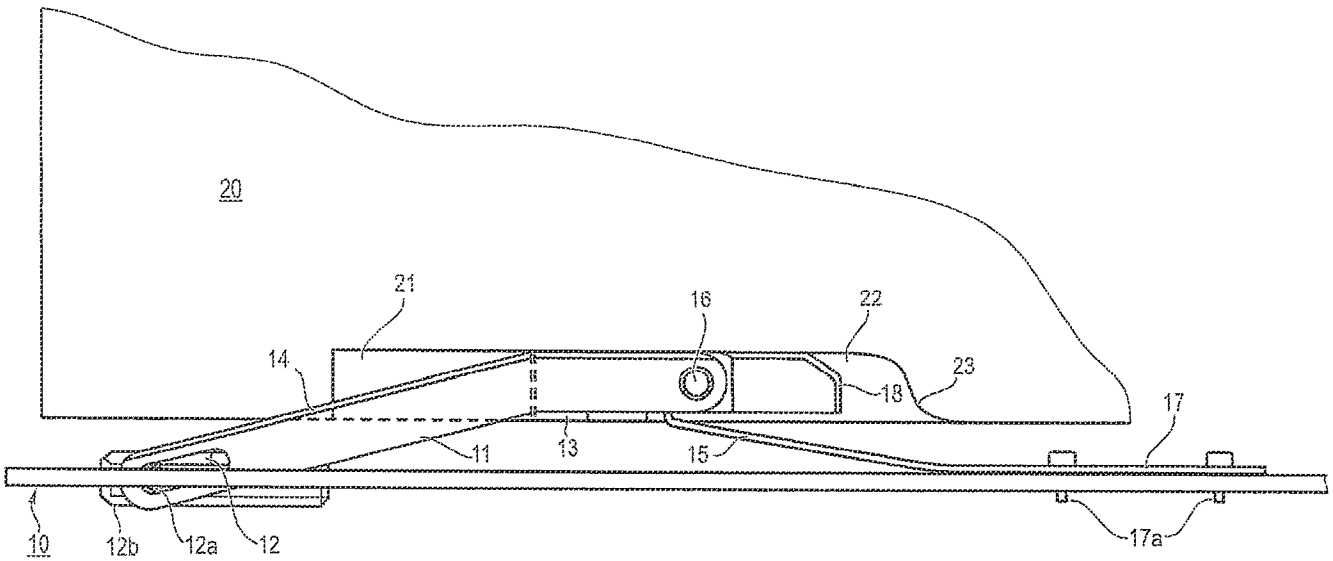
FIG. 2 shows a partial view of two device parts having plug connecting elements and being movable relative to each other with restrictive guidance.

In FIG. 2, the device only shown schematically in FIG. 1, is shown in a practical embodiment. This device forms part of a banknote container 20 which is inserted into the only partially illustrated device frame 10 of an output device. On its articulated end, the swivel arm 11 has an oblong hole 12 which is guided on a pin 12*a* mounted in the device frame 10, which pin is in turn held in an angle bracket 12*b* mounted in the device frame 10. On its other end, the swivel arm 11 has an axis of articulation 16 at which one end of the leaf spring 15 is fixed so that here an articulation between the leaf spring 15 and the swivel arm 11 is formed. With its other end 17, the leaf spring 15 is fixed to the device frame 10 by two screws 17*a*. When this arrangement is pressed downwards by the sliding movement of the banknote container 20 in the illustration in FIG. 2 then the associated extension of the mechanism comprised of the swivel arm 11 and the leaf spring 15 is made possible by the oblong hole 12 of the swivel arm 11.

FIG. 2 shows the position of the device frame 10 and the banknote container 20 in which the plug connection with the plug connecting elements 13 and 21 is established. The length of the recess 22 is dimensioned such that a movement of the banknote container 20 to the left is possible in order to, at first, separate the plug connection. Thereafter, a guiding projection 18 made of a slidable material and located at the free end of the swivel arm 11 abuts the right end of the recess in the area 23 which forms a concave-convex guiding surface for the guiding projection. This projection is guided without substantial resistance such that the entire swivel holder with the swivel arm 11 and the leaf spring 15 is moved out of the range of motion of the banknote container 20.

Figure 3:
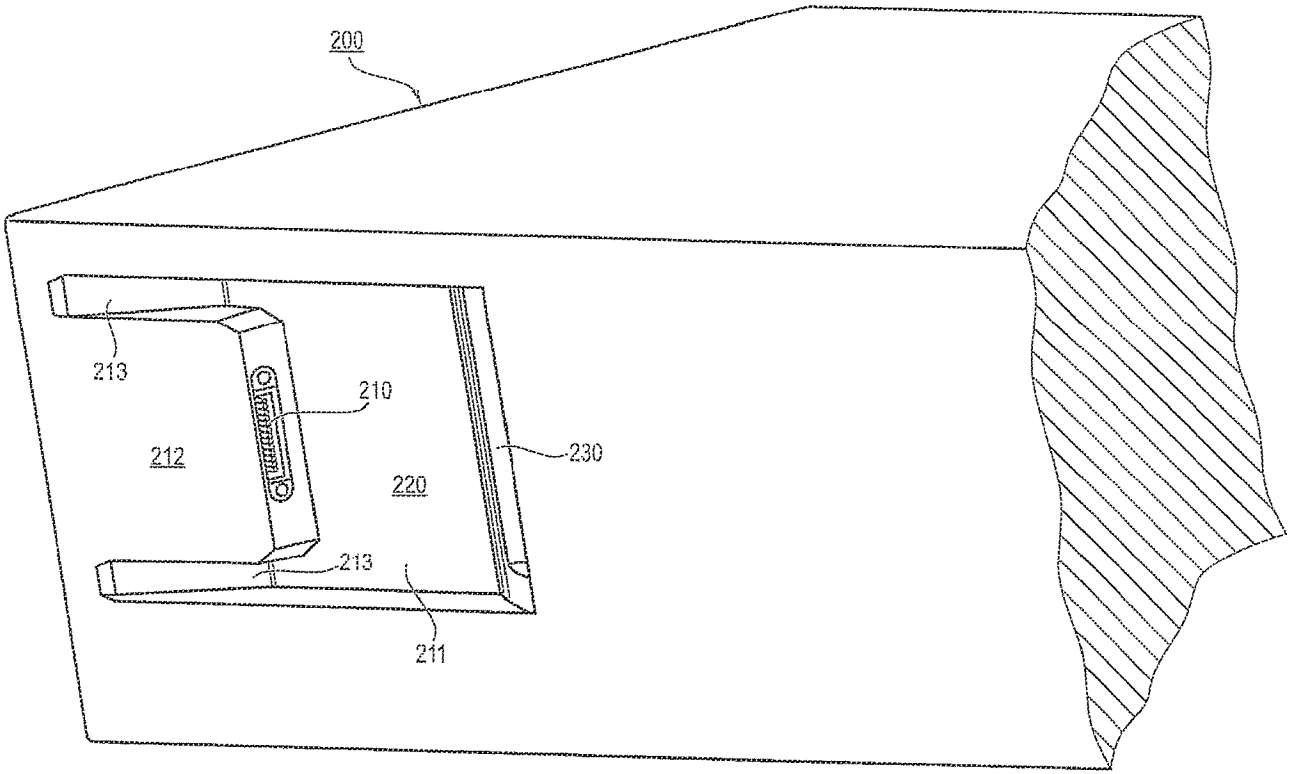
FIG. 3 shows a perspective partial view of a plug-in device with a plug connecting element mounted in a recess.

In FIG. 3, a banknote container 200 is partially illustrated in a perspective view, which on its longitudinal side wall has a recess 220 in which a plug connecting element 210 is arranged, the contact elements of which are oriented in the longitudinal direction of the banknote container 200. The plug connecting element 210 is mounted in a holder 212, the outside of which lies in the side wall plane of the banknote container 200. On both sides of the holder 212, the bottom 211 of the recess 220 passes, via inclined surfaces 213, over into the longitudinal side wall of the banknote container 200. The right-hand edge 230 of the recess 220 is formed in a curved manner, similar to the illustration in FIG. 2, in order to facilitate the sliding of a holder (not illustrated here) for a second plug connecting element.

Figure 4:
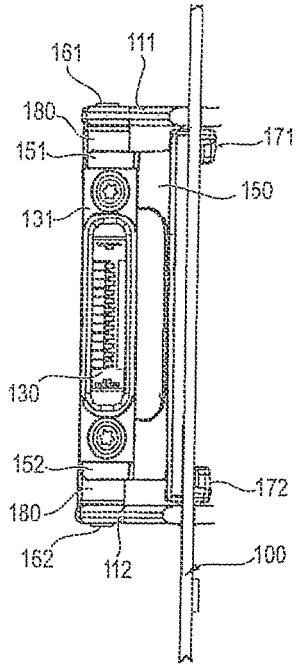
FIG. 4 shows a movable plug connecting element mounted on a device frame.

FIG. 4 shows the view of a plug connecting element 130 mounted in the wall of a device frame 100. Its holder corresponds to the principle shown in FIG. 1 and FIG. 2. The plug connecting element 130 is screwed on a carrier 131 to an articulated piece 180 which is articulated to an upper swivel arm 111 and a lower swivel arm 112 on bearing journals 161 and 162. The screw connection between the carrier 131 and the articulated piece 180 also serves to hold the ends 153 and 154 of two leaf spring arms 151, 152 of a leaf spring 150, the other end 170 of which is fixed to the wall of the device frame 100 with screws 171 and 172.

Figure 5:
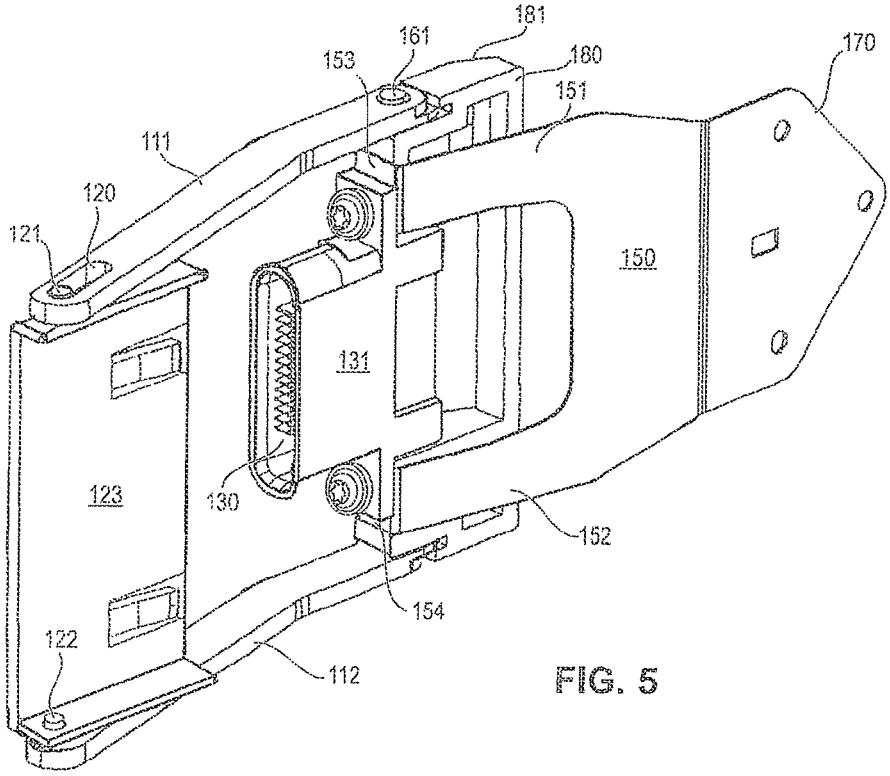
FIG. 5 shows a perspective illustration of the plug connecting element illustrated in FIG. 4 with its movable holder.

In FIG. 5, the arrangement shown in FIG. 4 is illustrated in a perspective view without the wall of the device frame 100. It can be seen that the carrier 131 for the plug connecting element 130 is mounted on a fork-like holder, the fork pieces of which are formed by the two swivel arms 111 and 112 and by the two leaf spring arms 151 and 152, the ends 153 and 154 of which are held between the carrier 131 and the articulated piece 180 by means of the screw connection. The articulated piece 180 connects the swivel arms 111 and 112 to the two leaf spring arms 151 and 152 at the bearing journals 161 and 162 (FIG. 4) and thus creates a rigid structure for carrying the plug connecting element 130. On its sliding side, the articulated piece 180 has a rounded-off sliding surface 181 which facilitates sliding over the edge 23 of the recess of a plug-in device 20, which edge is described in connection with FIG. 2.

Each of the two swivel arms 111 and 112 has at its front end in FIG. 5 an oblong hole 120 which is guided on a pin 121 and 122, respectively, which forms part of an angle bracket 123. This angle bracket is mounted in the wall of a device frame not illustrated in FIG. 5.

When the mechanism shown in FIG. 5 is mounted in the side wall of a device frame, the contact elements of the plug connecting element 130 are oriented in the longitudinal direction of the side wall so that an electrical contact can be established with a plug connecting element 210 of the type shown in FIG. 3, when the banknote container 200 shown in FIG. 3 is inserted into the device frame.

An embodiment of the invention has been described above, in which a movable plug connecting element is mounted on the wall of a device frame and the other plug connecting element is mounted stationarily in a plug-in device. It is likewise possible to mount the one plug connecting element in the plug-in device with a movable holder of the type described and to mount the other plug connecting element on the device frame in a stationary position.

Instead of a leaf spring, also another spring, e.g. a coil spring or a disc spring can be provided for resiliently biasing the movable plug connecting element. In this case, at the free end of the swivel holder an additional mechanical connection with the carrying element, i.e. for example with the wall of a device frame, may not be necessary, something which depends on the design of the spring used.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A device for establishing and disconnecting an electrical plug connection, said device comprising a first plug connecting element and a second plug connecting element of which are connected to each other on device parts when the latter are brought together, wherein the device parts can be moved relative to each other with restricted guidance and are guided against each other, as well as are separated from each other when the device parts are separated, in particular for electrically contacting circuits of a plug-in device with circuits of a device frame receiving the plug-in device, wherein the first plug connecting element is held at the first device part in a connecting position in which it is aligned with the second plug connecting element is the second connecting element being stationarily arranged in a recess in a longitudinal side wall of the second device part extending in sliding direction, and that when separating the first device part and second device part by sliding them relative to each other, the first plug connecting element being moved out of alignment with the second connecting element by the second device part contacting a spring connected to the first connecting element.

2. The device according to claim 1, wherein the first plug connecting element movable against the spring force is held at a swivel holder which on at least one swivel arm has a control edge which is inclined relative to the sliding path of the second device part, at which control edge the swivel holder is acted upon by the second device part when the second device part is moved in one of the two sliding directions.

3. The device according to claim 2, wherein a leaf spring stationarily held at the first device part with its one end acts with its other end on the swivel holder in the direction of the connecting position and forms a control surface which is inclined relative to the sliding path, at which control surface the swivel holder is acted upon by the second device part when the second device part is moved in the other one of the two sliding directions.

4. The device according to claim 2, further comprising a plug-in device to be received in a device frame, the plug-in device having a hollow-like recess on one of its longitudinal side walls, in which recess the second plug connecting element is stationarily arranged.

5. The device according to claim 4, wherein the swivel holder has two swivel arms arranged at a distance to each other which corresponds to the width of the recess transverse to the sliding direction, which swivel arms are guided on the device frame with oblong holes and carry the first plug connecting element between their free ends extending in the plug-in direction.

6. The device according to claim 5, wherein the free ends of the swivel arms are connected to each other via an articulated piece which holds them rotatably on bearing journals.

7. The device according to claim 6, wherein a two-armed leaf spring, the arms of which are connected to the articulated piece and act upon the latter in the direction towards the connecting position.

8. The device according to claim 6, wherein the articulated piece has a rounded-off sliding surface on its side facing the connecting position.

9. Apparatus comprising:

a removable device that is slidably inserted and removed from a frame;

the frame having a first electrical connecting element, a swivel holder and a spring; the swivel holder being connected at one end to the frame and at an opposite end to the first electrical connecting element, the spring being connected at one end to the frame and at an opposite end to the first electrical connecting element;

the removable device having a recess, a second electrical connecting element being located in the recess;

the swivel holder and spring being configured such that, upon initial insertion of the removable device into the frame, a first end of the removable device contacts the swivel holder causing the spring to deflect to move the first electrical connecting element to an initial insertion position;

the swivel holder and spring being configured such that, upon further insertion of the removable device into the frame, the spring moves the first electrical connecting element into the recess in the removable device; and wherein still further insertion of the removable device causes the first electrical connecting element to mate with the second electrical connecting element.

10. The apparatus of claim 9 wherein:

said removable device has a wall adjacent the recess;

the wall, the spring and swivel holder being configured such that, upon separation of the removable device from the frame, the wall deflects the spring to move the first electrical connecting element out of the recess in the removable device to permit the removable device to be completely separated from the frame.

* * * * *